US005335258A

United States Patent [19]

Whitlock

[11] Patent Number: 5,335,258

[45] Date of Patent: Aug. 2, 1994

[54] SUBMICROSECOND, SYNCHRONIZABLE X-RAY SOURCE

[75] Inventor: Robert R. Whitlock, Washington, D.C.

[73] Assignee: The United States of America as represented by the Secretary of the Navy, Washington, D.C.

[21] Appl. No.: 41,388

[22] Filed: Mar. 31, 1993

[51] Int. Cl.[5] ..... H01J 35/00

[52] U.S. Cl. ..... 378/122; 378/119

[58] Field of Search ..... 378/119, 121, 122

[56] References Cited

U.S. PATENT DOCUMENTS

| | | | |
|---|---|---|---|
| 3,823,325 | 7/1974 | Wood | 250/493 |
| 3,882,312 | 5/1975 | Kepres et al. | 250/493 |
| 4,058,446 | 11/1977 | Zirino et al. | 204/195 R |
| 4,206,364 | 6/1980 | Dixon et al. | 250/493 |
| 4,690,558 | 9/1987 | Tsunoyama et al. | 356/318 |
| 4,723,262 | 2/1988 | Noda et al. | 378/119 |
| 4,755,722 | 7/1988 | Wakalopulos | 315/111.31 |
| 4,993,037 | 2/1991 | Koseki | 372/58 |
| 5,003,543 | 3/1991 | Morsell et al. | 372/5 |
| 5,014,289 | 5/1991 | Rothe | 378/119 |
| 5,016,250 | 5/1991 | Rosen et al. | 372/5 |
| 5,042,058 | 8/1991 | Rentzepis | 378/122 |
| 5,089,711 | 2/1992 | Morsell et al. | 250/492.3 |
| 5,151,928 | 9/1992 | Hirose | 378/719 |

OTHER PUBLICATIONS

Zigler et al., High Intensity Generation of 9–13 Å x-rays from $BaF_2$ Targets, Appl. Phys. Lett. 59(7), pp. 777–778, Aug. 12, 1991.

Reintjes et al., Extended Plasma Source for Short-Wavelength Amplifiers, Opt. Ltrs, vol. 3, No. 2, pp. 40–42, Aug. 1978.

Murnone et al, Ultra fast X-ray Pulses From Laser--Produced Plasmas, Science, vol. 251, pp. 531–536, Feb. 1, 1991.

Van Wonterghem et al., Characteristics of a Td Photo cathode for the Generation of Picosecond X-ray Pulses, Appl. Phys, Lett, II, pp. 1005–1007, Mar. 12, 1990.

Elsayed-Ali et al., Picosecond Reflection High-Energy Electron Diffraction, Appl. Phys. Lett 52(2), pp. 103–104, Jan. 11, 1988.

Gilomer et al., Fast Ions and Hot Electrons in the Laser-Plasma Interaction, Phys. Fluids 29(8), pp. 2679–2688, Aug. 1986.

Priedhorsky et al., Hard X-Ray Measurements of 10.6 μm Laser-Irradiated Targets, Phys. Rev. Lett. vol. 42, No. 2, pp. 1661–1664, Dec. 7, 1981.

Armstrong et al., Emission of Energetic Electrons from a Nd-Laser Produced Plasma, J. Appl, Phys. 50(8), pp. 5233–5237, Aug. 1979.

*Primary Examiner*—Craig E. Church

*Attorney, Agent, or Firm*—Thomas E. McDonnell; Charles J. Stockstill

[57] ABSTRACT

In the submicrosecond, synchronizable x-ray source a high intensity pulsed laser is focused onto a negatively biased laser target, at high irradiance in a vacuum, producing high temperature plasma from which electrons are emitted. The emitted electrons are accelerated in a electric field formed by impressing a potential difference across a laser target-electron target gap. The positively biased electron target collects the emitted electrons, which upon impact with the electron target cause x-rays to be emitted synchronously with the incident laser pulse.

17 Claims, 2 Drawing Sheets

SUBMICROSECOND, SYNCHRONIZABLE X-RAY SOURCE

BACKGROUND OF THE INVENTION

1. Field of the Invention

This invention pertains to the generation of x-rays and particularly to a method and apparatus for obtaining pulses of ionizing photons (X-rays and ultraviolet) resulting from the impact of free electrons emitted by a pulsed plasma on an anode in an impressed electric field.

2. Description of the Related Art

Widespread technological use has been made of the photocathode principle, according to which a negatively charged material is illuminated by light and the emitted electrons are then collected at an anode. Electrons emitted by a laser-irradiated photocathode have been accelerated in an electrostatic field, up to energies (18 kV) sufficient to perform 180 ps electron diffraction experiments on very thin metallic foils. In related work, the photoelectrons stimulated by an 18 ps laser pulse incident on a metallic cathode were accelerated in a static electric field, and used to produce an electron impact x-ray source of 70 ps duration. The electron current was space charge limited, even at 60 kV bias potentials.

Photoemission has been recognized for several years as a unique electron source. The energy distribution, the polarization, and the time profile of the electron beam can be carefully controlled by manipulating the wavelength, the polarization, and the time dependence of the excitation light source. Photoemission is induced by the linear photoelectric effect using picosecond pulses of a frequency-quadrupled Nd:YAG laser. For a full discussion of this technique, See, Van Wonterghem and Rentzepis, *Characteristics of a Ta Photocathode for the Generation of Picosecond X-ray Pulses,* Appl. Phys. Lett. 58(11), 12 Mar. 1990.

SUMMARY OF THE INVENTION

The object of this invention is a device that produces a synchronizable, x-ray source using pulsed ablation plasmas to emit electrons.

A further object of this invention is to provide an apparatus and method for generating x-rays with electron emitting ablation plasma that is relatively compact and capable of being utilized in a average laboratory facility without expensive construction and operation expenses.

The submicrosecond, synchronizable x-ray source is a device where a high intensity pulsed laser is focused through a lens onto a negatively biased laser target (cathode) inside a vacuum housing. This produces ablation plasma from which electrons are emitted. The electrons emitted from this ablated plasma are accelerated in a static electric field formed by impressing a potential difference across a cathode-anode gap. The positively biased electrode (anode) collects the emitted electrons, causing x-rays to be emitted as the electrons impact the anode. The x-ray pulses are synchronous with the formation of the plasma.

BRIEF DESCRIPTION OF THEDRAWINGS

DESCRIPTION OF THE PREFERRED EMBODIMENTS

Figure 1:
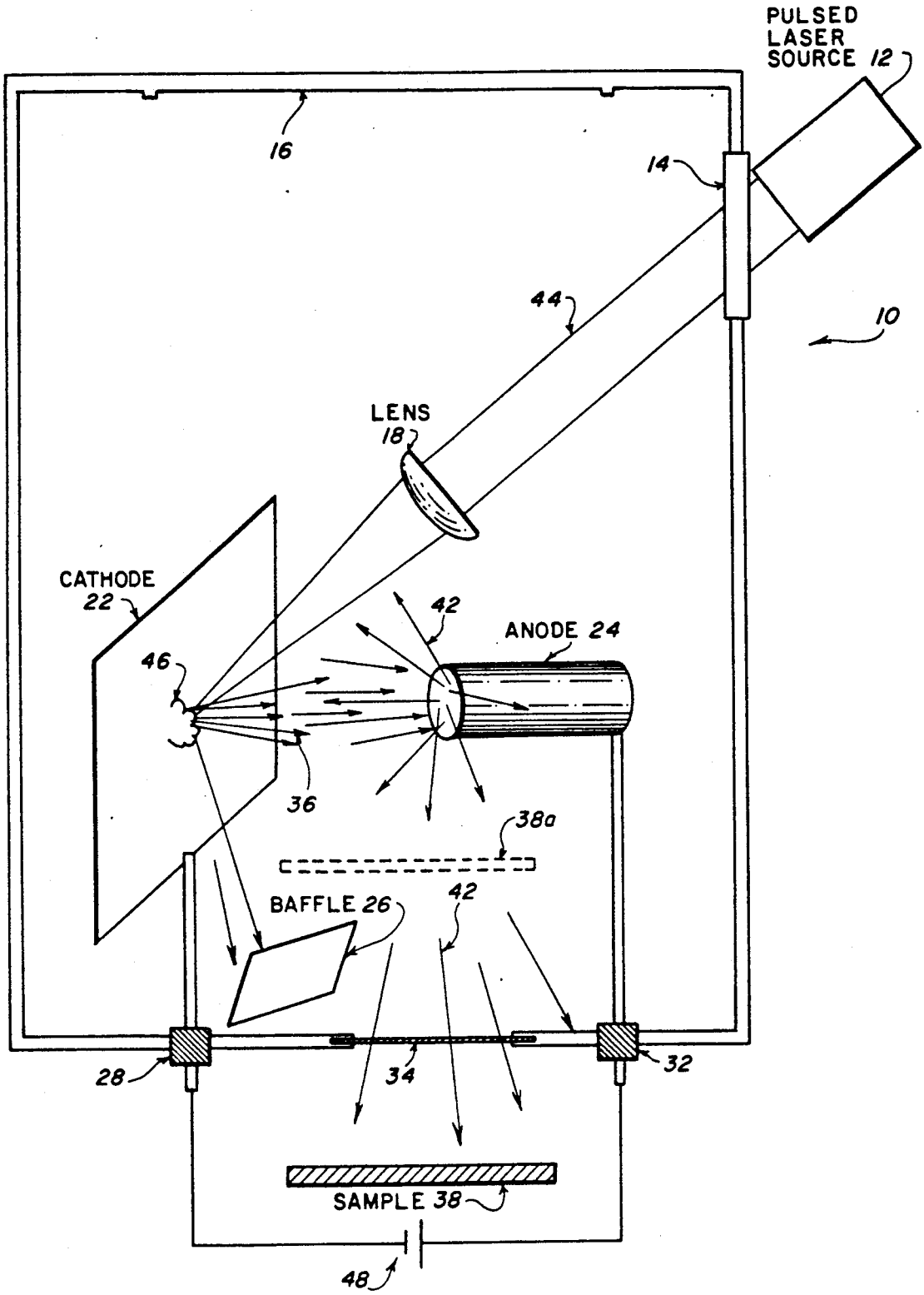
FIG. 1 is a schematic of the Synchronizable X-Ray Source apparatus with a synchronizable laser source apparatus.

In a first preferred embodiment, FIG. 1, the synchronizable laser plasma electron source 10 includes a pulsed laser source 12, laser target (cathode) 22, an electron target (anode) 24, electrical leads 28 and 32 to the cathode and anode 22 and 24, respectively, and a vacuum housing or vessel, 16.

The vacuum housing 16 may contain any type of gas, or none at all, as long as the optimum vacuum is maintained below a TORR. However, the actual vacuum present will depend upon the physical size of the system design and the breakdown characteristics of the electrical (accelerating) potential maintained between the laser target 22 and the electron target 24. The essential requirement is that the pressure within the vacuum housing be sufficiently low so that the accelerating potential does not precipitate spurious electrical breakdown and that the accelerated electrons transit through from source to target without precipitating a breakdown. Therefore, it is possible to produce x-rays with pressures higher than a TORR if the system design is very compact.

The pulsed laser source 12 is outside of a vacuum housing 16, therefore a laser window 14 is required to project the laser beam 44 through a lens 18 onto the laser target or cathode 22. The type of material utilized for the laser window 14 will depend upon the wavelength of the laser 12 used. These are considerations well known to individuals practicing within the art. To focus the laser beam 44 upon the target, the lens may also act as a laser window 14.

The vacuum housing 16 may also include shielding, or baffling, 26 to occlude the direct emissions, or ejecta, from a laser ablation plasma 46 which may irradiate or damage the sample window 34. The positioning of samples may be either within the vacuum housing 16, as shown by sample 38*a*, or outside of the vacuum housing 16, as shown by sample 38. The sample window 34 is made from an organic material like kapton or a thin metal foil or a similar material.

Further, a filter (not shown) may be imposed between the anode 24 and the sample 38. The type of filter would be dictated by the x-ray 42 absorption characteristics of the filter and the x-ray spectrum generated. If required, the selection of such a filter is well known within the art. The filter may also serve as a baffle to protect the sample 38*a* from ejection from the laser plasma 46.

A high intensity pulsed laser 12, such as a pulsed $CO_2$ laser or pulsed Nd:YAG laser, is focused onto a negatively biased laser target or cathode 22 at high irradiance in the vacuum housing 16, producing ablation plasma 46. The plasma threshold typically occurs at $10^9$ watts/cm$^2$ whereat the plasma 46 emits electrons 36 which a positively biased electrode, an electron target or anode 24, collects and causes x-rays 42 to be emitted in step or synchronously with the incident laser pulses 44 as the plasma electrons impact upon the electron target 24. For sufficiently high irradiance, the emitted electron 36 energies are readily measurable and range into the hundreds of kilovolts. The period of illumination, or pulses 44, of the laser target 22 by the laser beam 44 may be of any duration required to support the $10^9$ watts/cm$^2$ typically required for ablation plasma generation, or higher irradiance level which may be employed. Subpicosecond laser pulses may require higher irradiances to form an ablation plasma. Control of the period of illumination, or laser pulsing, is accomplished by laser design by timed electrical switching of the laser discharge circuits or by electrically controlled optical gates.

The laser target, or cathode, 22, can be made of any material that is capable of withstanding ambient conditions within the chamber, or any combination of layers of material or mixtures of materials. Metallic cathodes are most commonly utilized in standard x-ray tubes because they are easily charged and readily conduct electrons. Of the metallic cathodes, copper is the most common metal used, however, tantalum, tungsten, molybdenum, or a similar metal is suitable. For pulses longer than the electron travel time between the laser target 22 and anode 24, the anode 24 must conduct the electrons 36 away. If this is not accomplished, the electron target 24 will charge up and the electrons will be steered away from the electron target 24.

Shapes of the laser target 22 and anode 24 are arbitrary. However, the laser target 22 should be of sufficient size to produce plasma ignition with the wavelength of the laser being employed. A planar geometry has been found to be satisfactory for both the laser target 22 and anode 24. At low irradiances, the shape of the laser target will not affect the number of electrons 36 being generated but it may influence their trajectory. At the anode 24 it is desired that as many electrons 36 as possible be concentrated to arrive upon it. For uses where the largest number of x-rays is desired, a large anode 24 is useful to permit interception of the largest number of electrons 36. For uses needing spatial resolution and limited projected source size, it is preferable for the anode 24 to present a small projected size to the sample 38. The preferred size is determined by the end use. For example, millimeter projected sizes are common for x-ray sources used in diffraction work. It may be desirable to limit the size of the anode 24 so that the potential results in the attracting of the electrons 36 down to the smallest point possible.

The spacing between the laser target 22 and anode 24 can be no closer than the distance at which spontaneous electrical breakdown will develop in the absence of the laser pulse. At room temperature, for example, a biplaner diode with one electrode formed of metal mesh will breakdown spontaneously when held above approximately 20,000 V/cm at ambient gas pressures somewhat below $10^{-4}$ TORR.

In addition to the emitted electron 36 current, a current may be designed to flow between the laser target 22 and electron target 24, through the expanding, electrically conductive, laser plasma 46. The source of this current is the voltage supply 48 which establishes the potential difference between the laser target 22 and anode 24. Prior to the laser event, no current can flow since there is no conductor to support the current. Once plasma 46 fills the gap between the electron target 24 and the laser target 22, a current path can be established. The electrons 36 from the ablation plasma 46 are accelerated in the static electric field formed by impressing the potential difference across the gap between the laser target 22 and electron target 24. The additional current supported by the potential difference between the laser target 22 and anode 24 will lengthen the x-ray pulse and increase the total x-ray 42 output. The duration over which the accelerating potential is applied between the laser target 22 and electron target 24 cannot be made shorter than ultrafast (subpicosecond) laser pulses. Thus, for ultrafast laser pulses, the acceleration potential will effectively be static, even if it is applied for only a few nanoseconds. For laser pulses of about a nanosecond or longer, and for the electron discharge method of establishing the electron emitting pulse, the duration of the electron emission 36 can be longer than the pulse durations which can be achieved by pulsing the accelerating potential. In these cases, the x-ray pulse 42 width can be shortened by applying the accelerating potential in a pulsed fashion, the accelerating potential pulse width being shorter than the electron emission time.

Optimization of this component can be performed by regulating the plasma 46 volume and expansion geometry, and the charge delivery of the biasing circuitry. Plasma 46 volume is governed by laser 12 focal irradiance, size and history. With a higher irradiance laser beam 44 focused onto the laser target more energetic plasma is produced with a higher temperature. Particles in this energetic plasma will expand more rapidly, some of the plasma will expand out into the gas and the electrons 36 and the ions will eventually recombine to make neutrals (particles carrying no net electron charge) which have little effect upon the generation of x-rays 42. Multiple laser pulses can sustain ionization of the gaseous matter between the cathode 22 and anode 24. The high temperature plasma 46 also can emit sufficient ultraviolet radiation to ionize the background gas in the vacuum housing.

Under some conditions sufficiently energetic electrons 36 can be generated that will be emitted by the plasma 46 with sufficient strength to generate x-rays 42 upon impacting the anode 24, without the presence of an accelerating field, that is without the biasing potential 48. To achieve this the electron 36 energy must at least equal the photon energy of the x-ray desired to be developed. For example, if an x-ray 42 with an energy of 5 kV is desired, an electron 36 with an energy of 5 kV, or greater, must strike the anode 24. If an overvoltage exists, a situation where there is more electron 36 energy present than the photon, or x-ray, 42 energy being sought, the efficiency of production of the photon 36 increases. Therefore, with an electron 36 energy of 15 kV, 5 kV x-rays 42 can be made more efficiently. Hence, with no biasing voltage present, when operating at high irradiances producing 150–600 kV electrons 36, sufficient energy will be present to generate x-rays 42 without an accelerating potential between the laser target 22 and anode 24. (A more exact treatment of the energy relationships between impacting electrons, target atom energy levels, and emitted x-ray photon energies can be found in elementary texts on x-ray physics, for example, *Elements of X-ray Diffraction,* B. D. Cullity, Addison-Wesley Publishing Co., Inc., Reading, Mass.)

The electrons 36 are emitted into a fairly large angle, thus to obtain a small x-ray 42 source size, the electron trajectory may be shaped by electric or magnetic fields (not shown). The aid of an impressed high voltage 48 may be utilized in guiding the electron 36 flow to the anode 24 from the laser target 22.

Low energy plasma electron emission can be achieved at or above the plasma ignition threshold (where the laser irradiance on the surface of the target is about $10^9$ watts/cm$^2$). In order to achieve the high irradiances ($10^{14}$ watts/cm$^2$, or greater) necessary for highly energetic electron emission, an amplified laser is required. Longer wavelength lasers, such as the $CO_2$ lasers, are more effective than shorter wavelength lasers, such as Nd:YAG, in producing copious electron emissions from the plasmas they produce. However, a full spectrum of lasers with emissions from the infrared to ultraviolet range may be utilized. Although sufficient numbers of electrons of high energy are obtained with a sizeable laser of 1 μm wavelength, which will produce 8 Joules, 75 ps pulses focusable to an irradiance of $10^{15}$–$10^{16}$ watts/cm$^2$, such a facility is too large for most laboratory purposes. The same irradiances can be reached with the same spot sizes by an amplified laser of 75 fs pulse width having 8 mJ energy per pulse. Lasers of this sort, operating at 0.6 μm, can be built from commercially available components, using the technical base already available to persons in the art.

For calculating the x-ray 42 production for 100 keV electrons 36, the output of the principle (Kα) line radiation in thick copper targets is $9.0\times10^{-3}$ keV/(steradian-electron), or about $10^{-3}$ photons/(sr-elec). Given charges of one nanocoulomb (1 nC), or about $6\times10^9$ electrons/pulse, this equates to $6\times10^6$ photons/sr per pulse. Assuming a sub-mm areal x-ray source, this implies a flux on the order of a few $10^8$ photons/cm$^2$ uncollimated photons at 8 KeV into a mm$^2$ area at 1 mm separation, in a single pulse.

The total output of the source, over $2\pi$ sr, is estimated as about $3\times10^8$ photons/pulse for the Cu K line at 8 keV, or $4\times10^{-8}$ J ($2.4\times10^{11}$ eV), where eV is an electron volt. The spectral brightness (disregarding source size and collimation) for this 4 eV wide line is then about $6\times10^{10}$ eV/eV. By comparison, 2–3 mJ ($2\times10^{16}$ eV) of broadband, lower energy x-rays were emitted per shot in the range 8–16 Å (energy spread of 0.8 keV) directly from a high temperature plasma formed at the focus of a 600 fs, where fs is a femtosecond, 248 nm laser pulse, for which the spectral brightness is $2.5\times10^{13}$ eV/eV. The electron impact source, while about 400× less intense in these estimates, achieves higher photon energies. The estimated $10^4$ shots required to expose x-ray film for the electron impact source can be achieved in 100 sec. at 100 Hz; film is not the most sensitive x-ray detector available. During the course of a run, target 22 replenishment is normally required, therefore the design of the vacuum housing 16 requires the inclusion of a provision for accessing the laser target 22 and readily replacing the material.

The above calculations assume that space charge limitation does not apply since the starting point of the calculation is the number of electrons actually measured to have been emitted. For reference, the equation for the space charge limit for a biplanar diode is $$J=2.3\times10^{-6}\,V^{(3/2)}/d^2$$

where J is the current density (Amperes/cm$^2$), V is the voltage, and d=0.04 J is $1.3\times10^{-5}$ A/cm$^2$. A current of 1 nC/$10^{-12}$ s (1000A) is then space charge limited for areas of $7.6\times10^{-3}$ cm$^2$, which corresponds to a circle of a radius of 490 μm.

The high flux, synchronizability and temporal resolution of the electron impact events makes repetitive x-ray measurements possible, much as are commonly performed at synchrotrons. The mm spacing is much more than the thickness of x-ray filters (not shown) or x-ray transmitting vacuum windows 34 which might be used in such experiments. Thus, a filter (not shown) could be interposed between the laser source 12 and the sample 38 at these spacings. The laser beam optics, or lens, 18 may be configured outside the vacuum housing 16, which then has a window 14 through which the laser beam 44 passes.

Figure 2:
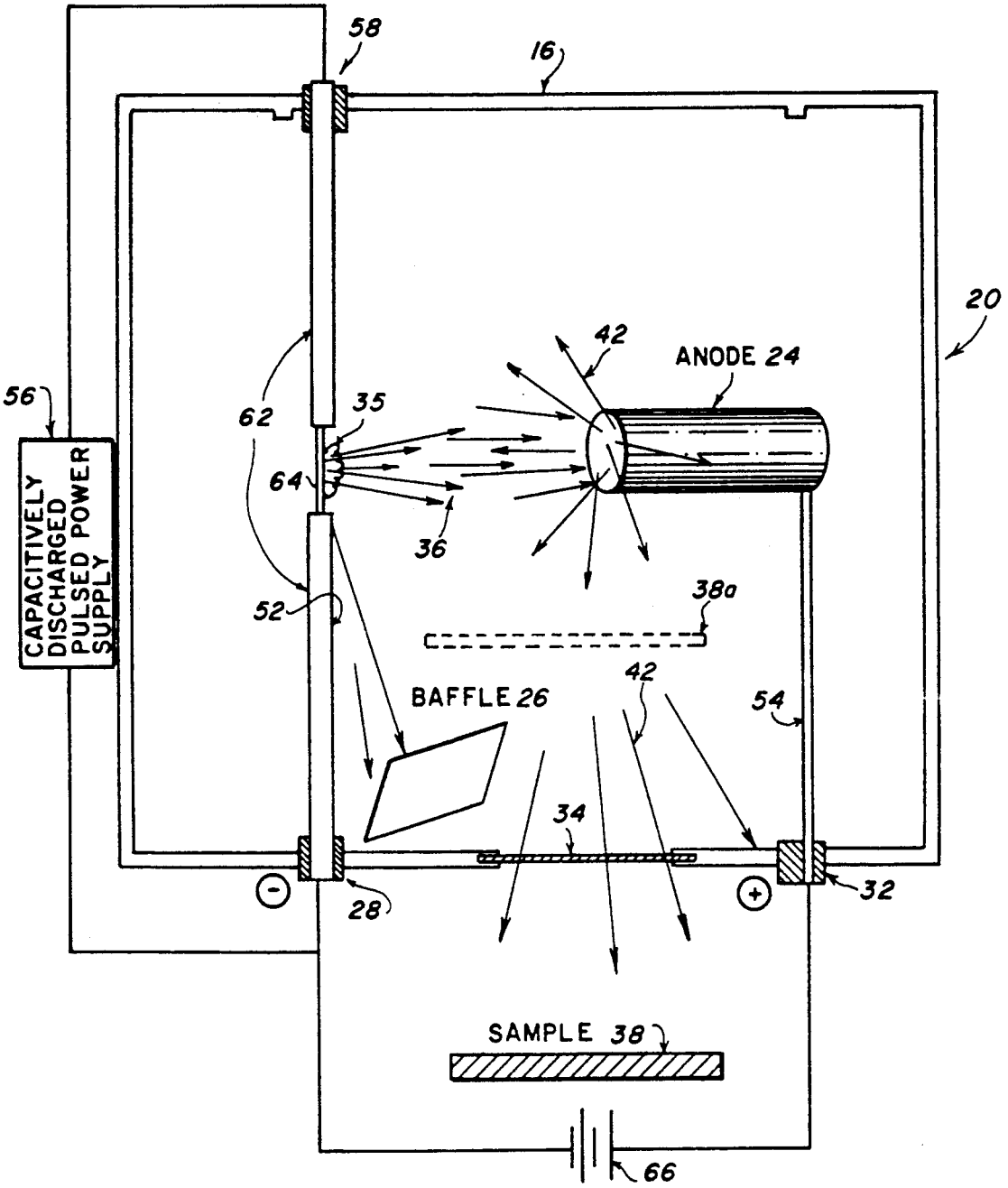
FIG. 2 is a schematic of a Synchronizable X-Ray source apparatus with a pulsed power electron emitter source.

In a second preferred embodiment, FIG. 2, the pulsed electron power source 20 provides a pulsed electron power emitter for an x-ray source. Emission of the x-rays produced is synchronized with the pulsing of the electron power source. To achieve the pulsed electron power source, a high current, capacitively discharged, pulsed electrical power supply 56 is connected to a first large, high current carrying conductor 62 in the vacuum housing 16. A gap in the high current conductor 62 is spanned by a second, smaller, conductor 64, which may be a wire, a film of a metallic material on a nonconducting substrate, a puff of gas or a (low irradiance) laser generated plasma (e.g., Nd:YAG laser). The type of metallic film or gas forming the second conductor is immaterial.

The pulsed electrical power supply 56 is capacitively discharged across the second conductor 64. As the high electrical current passes through the second conductor 64 the temperature within the conductor 64 raises substantially so that an ablation plasma 35 is established and plasma electrons 36 are emitted. The plasma electrons 36 are attracted to the anode 24 by a positive potential established by a power supply 66 which is separate and distinct from the pulsed electrical power supply 56. The generation of x-rays 42 at the anode 24 then is as described in the first preferred embodiment.

The pulsed power electron source 20 is advantageous in that electrical currents provide the bulk (or all) of the power needed to establish the plasma electron 36 emission. Such circuitry is capable of repetitive operation, and does not suffer from the efficiency losses inherent in producing laser pulses of high irradiance. Thus, higher repetition rates are sustainable when compared with the laser driven plasma electron source. However, the synchronizable laser plasma electron source 10 will provide higher power densities owing to their very fast rise times and spatial focusability. Therefore, laser sources will offer faster x-ray pulses.

The laser 12 in the synchronizable laser plasma electron source 10, FIG. 1, is utilized to drive the ablation plasma 46 in its entirety, whereas the low irradiance laser (not shown) is utilized in the pulsed power electron emitter source 20, FIG. 2, to establish a conductive path 64 over which the electrical current is passed to establish an ablation plasma 35 which emits electrons 36 more copiously than would be the case with a low irradiance laser alone. In the second conductive path 64 when the low irradiance laser (not shown) irradiation is heated by the electron power source discharge an ablation plasma 35 is generated. An additional advantage of using a low irradiance laser (not shown) is that the conductive path over which the current passes may be established on a material which is normally insulating and which may be reused for many other pulses undergoes only slight degradation per pulse.

The apparatus described in the above embodiments provides a relatively compact method for generating x-rays that is capable of being utilized in an average laboratory facility without expensive construction or operating expenses.

Although the invention has been described in terms of the exemplary preferred embodiments thereof, it will be understood by those skilled in the art that still other variations and modifications can be effected in these preferred embodiments without detracting from the scope and spirit of the invention.

What is claimed is:

1. A synchronizable x-ray source for generating x-rays within a vacuum housing that are collected upon a sample, comprising:

a laser source capable of generating a high irradiance laser light;

a means for receiving the high irradiance laser light within the vacuum chamber to generate plasma emissions;

means for receiving said plasma emissions to generate x-rays; and means for allowing said x-rays to exit said vacuum housing to be collected by said sample.

2. A synchronizable x-ray source, as in claim 1, wherein the laser source is located outside of said vacuum housing.

3. A synchronizable x-ray source for generating x-rays that are collected upon a sample comprised of:

vacuum housing;

laser source generating a pulsed laser beam projected into the vacuum housing;

laser target within the vacuum housing from which plasma electrons are emitted when the pulsed laser beam strikes the laser target;

electron target within the vacuum housing for collecting the plasma electrons emitted from the laser target and causing x-rays to be emitted that are synchronized with the laser beam pulses; and a sample window through which the x-rays pass to be collected upon the sample.

4. A synchronizable x-ray source, as in claim 3, further comprising a means for focusing the laser beam onto the laser target.

5. A synchronizable x-ray source, as in claim 3, further comprising a baffle within the vacuum housing between the laser target and the sample window to prevent mass ejected by the laser target from being deposited upon either of the sample and the sample window.

6. A synchronizable x-ray source, as in claim 3, further comprising a means for producing a electric field potential between the laser target and the electron target for accelerating the plasma electrons;

7. A synchronizable x-ray source, as in claim 3, wherein the laser source is in the spectrum range from an infrared to the ultraviolet band.

8. A synchronizable x-ray source for generating x-rays that are collected upon a sample comprised of:

vacuum housing;

laser source generating a pulsed laser beam with a power of $10^9$ watts/cm$^2$ projected into the vacuum housing;

laser target within the vacuum housing from which plasma electrons are emitted when the pulsed laser beam strikes the laser target;

electron target within the vacuum housing for collecting the plasma electrons emitted from the laser target and causing x-rays to be emitted that are synchronized with the laser beam pulses; and a sample window through which the x-rays pass to be collected upon the sample.

9. A method for producing x-rays comprising the steps of:

focusing a high intensity synchronizable laser beam onto a laser target within a vacuum housing thereby producing electron-emitting ablation plasma;

generating electron emissions from the plasma when the laser beam strikes the laser target;

collecting the electrons on an electron target;

emitting x-rays from the electron target when the emitted electrons strike the electron target; and collecting the x-rays on a sample.

10. A method, as in claim 9, further comprising the step of producing an impressed electric field potential across the laser target-positively biased electrode gap to accelerate the electrons to the electrode.

11. A synchronizable x-ray source, for generating x-rays collected upon a sample comprised of:

vacuum housing;

first electrical power source for generating a pulsed electrical current;

electrical conductor inside of said vacuum housing having a gap in said conductor;

electrical conductor means across the gap in the first electrical conductor for conducting the pulsed electrical current so as to generate a flow of plasma electrons when the pulsed electrical current flows through the electrical conductor means;

electron target within the vacuum housing for collecting the plasma electrons emitted from the electrical conductor means and causing x-rays to be emitted that are synchronized with the pulsed electrical current;

second power supply for producing a static electrical field potential between the second electrical current conductor and electron target for accelerating the plasma electrons; and sample window through which the x-rays pass.

12. A synchronizable x-ray source, as in claim 11, further comprising a baffle within the vacuum housing between the sample window to prevent mass ejected by the electrical conductor means from being deposited upon either of the sample and the sample window.

13. A synchronizable x-ray source, as in claim 11, wherein the electrical conductor means is a conducting metallic strip.

14. A synchronizable x-ray source, as in claim 11, wherein the electrical conductor means is a film of conducting material on a nonconducting substrate.

15. A synchronizable x-ray source, as in claim 11, wherein the electrical conductor means is a gaseous vapor.

16. A synchronizable x-ray source, as in claim 11, wherein the electrical conductor is a of plasma formed by irradiating the gap with a laser light.

17. A method for producing x-rays comprising the steps of:

generating a capacitively discharged high current electrical pulse across a gap in an electrical conductor containing a electrical conductor means within a vacuum vessel to generate a flow of plasma electrons;

impressing a static field potential across the separation between the electrical conductor means and a positively biased electron target to accelerate the flow of the plasma electrons to the electron target;

collecting the plasma electrons on the positively biased electron target;

emitting x-rays from the electron target when the plasma electrons strike the electron target; and, allowing the x-rays to pass outside of the vacuum vessel through a sample window to be collected by a sample.

* * * * *